US010881928B2

(12) United States Patent
Morelock et al.

(10) Patent No.: US 10,881,928 B2
(45) Date of Patent: Jan. 5, 2021

(54) STABLE GOLF PUTTER HEAD WITH ENHANCED MOMENT OF INERTIA

(71) Applicants: David Michael Morelock, Escondido, CA (US); Travis Donald Downing, Carlsbad, CA (US); Robert Raymond Lang, Vista, CA (US)

(72) Inventors: David Michael Morelock, Escondido, CA (US); Travis Donald Downing, Carlsbad, CA (US); Robert Raymond Lang, Vista, CA (US)

( * ) Notice: Subject to any disclaimer, the term of this patent is extended or adjusted under 35 U.S.C. 154(b) by 0 days.

(21) Appl. No.: 16/231,341

(22) Filed: Dec. 21, 2018

(65) Prior Publication Data

US 2020/0197767 A1 Jun. 25, 2020

(51) Int. Cl.

| | |
|---|---|
| ***A63B 53/04*** | (2015.01) |
| ***A63B 53/06*** | (2015.01) |
| ***A63B 53/00*** | (2015.01) |
| *A63B 102/32* | (2015.01) |

(52) U.S. Cl.

CPC ..... *A63B 53/065* (2013.01); *A63B 53/007* (2013.01); *A63B 53/0487* (2013.01); *A63B 53/04* (2013.01); *A63B 2053/0491* (2013.01); *A63B 2102/32* (2015.10)

(58) Field of Classification Search

CPC ..... A63B 2053/0491; A63B 53/007; A63B 53/0487; A63B 53/065; A63B 53/04

USPC ..... 473/341, 340, 345, 334–339

See application file for complete search history.

(56) References Cited

U.S. PATENT DOCUMENTS

| | | | | | |
|---|---|---|---|---|---|
| 4,871,174 | A * | 10/1989 | Kobayashi | A63B 53/0487 | 473/252 |
| 4,872,684 | A * | 10/1989 | Dippel | A63B 53/0487 | 473/253 |
| 5,193,806 | A * | 3/1993 | Burkly | A63B 53/04 | 473/309 |
| 6,409,613 | B1 * | 6/2002 | Sato | A63B 53/0487 | 473/337 |
| 2006/0172816 | A1 * | 8/2006 | Johnson | A63B 53/0487 | 473/334 |
| 2008/0146372 | A1 * | 6/2008 | John | A63B 53/007 | 473/341 |
| 2009/0258725 | A1 * | 10/2009 | Jones | A63B 53/0487 | 473/341 |

* cited by examiner

*Primary Examiner* — Benjamin Layno

(57) ABSTRACT

Briefly, a putter head is provided that concentrates the weight of the putter head at the far ends of the heel and toe of the putter head. The putter head has an ultralight putter body that includes a putter face and a shank for attaching a putter shaft. The ultralight putter body has an axially aligned heel cavity and toe cavity that are constructed to receive weights. The heel weight and toe weights are very dense, and constructed to be received into the respective weight cavity of the light putter body. Due to the extreme concentration of weight at the fare ends of the heel and toe of the putter head, the putter face has exceptional rotational stability with a substantially larger sweet spot than known putter heads. The weights may be provided as changeable weight pairs, such that the overall weight and balance of the putter head may be adjusted, while maintaining the position of the sweet spot.

21 Claims, 9 Drawing Sheets

STABLE GOLF PUTTER HEAD WITH ENHANCED MOMENT OF INERTIA

FIELD OF THE INVENTION

This invention relates to a golf putter, and in particular to the head of a golf putter with an axial weighting system.

BACKGROUND OF THE INVENTION

Worldwide, the game of golf is a tremendously popular sport. Generally, the game of golf consists of an arranged progression of 18 holes, although other size courses are common. Each hole has a tee box where a golfer uses a driver or other long-distance club to strike a small golf ball along a fairway and towards a green. Although some holes may be short enough for the golfer to make it from the tee box directly to the green, most holes require that one or more additional strikes be made from the fairway toward the green. Once on the green, the golfer uses a golf putter to coax the golf ball into the hole in as few strokes as possible.

Golf, then, requires the golfer to have three key skill sets: driving, fairway shots, and putting. Each has its own equipment and athletic challenge, but most golfers consider putting to be the most challenging aspect of the game and most prone to inconsistency. Accordingly, golfers spend substantial time practicing their putting, often referred to as their "short game", as well as taking instruction and purchasing new putters.

There are many types of putters on the market, of different lengths, weights, and grip styles. A golf putter generally consists of a long shaft connected to a putter head. The shaft can be long or short, and can made of various types of materials. The putter head has even more options, and can be shaped as a blade or an oblong mallet, and the face that hits the ball can be made of exotic materials and patterns. Further, golfers use different techniques in handling their putters. For example, some may use a pendulum type swing (arc stroke) where the golfer's upper body remains still, while the putter head moves through a long arc-shaped stroke, while others make a shorter and more lateral motion that is more of a "pop" or "rap" to the ball.

In order to hit a consistent and controlled putt, the face of the putter head needs to squarely contact the ball at or very near what is commonly called the "sweet spot" of the putter face. Missing the sweet spot even by a small amount, or hitting even at a slight angle, may cause the golf ball to unexpectedly rotate offline, and most certainly will cause the golf ball to travel slower and to a shorter distance than expected. It is the ability of a professional golfer to consistently and squarely strike the sweet spot that enables the consistent and predictable speed and line of his or her putting. The sweet spot is generally considered the spot on a putter where, when a golfer strikes a golf ball, the center of gravity of the putter face is moving directly toward the center of gravity of the golf ball. If the golfer misses the sweet spot, then the putter face will twist slightly at impact, and less energy will be transferred to the golf ball, and the golf ball will travel a shorter distance than expected. Accordingly, the closer to the sweet spot that the putter face hits the ball, the more energy that will be transferred into the ball. More energy transferred perpendicular to the putter face means a longer, straighter, and more controlled putt. And as a consequence, more enjoyment for the golfer.

However, the design and construction of current putter heads results in a frustratingly small sweet spot, often just a few millimeters in diameter. Unless the golfer is extremely skilled, it is unlikely the golfer will have good consistency in hitting the sweet spot, leading to frustration and a less enjoyable game experience. It is known that adjusting the position of weights in a putter head can change the position of the sweet spot. For example, U.S. Pat. No. 5,244,210 provides a putter head design with movable weights to move the position of the sweet spot. However, this design does not address the problem that sweet spot is too small, and requires a complex arrangement of weights, springs, and spacers, which would negatively affect the overall feel and sound of the putter head.

In another example of an adjustable putter head, a golf putter head has slots or openings in the bottom (sole) of the putter head for receiving one or more weights. This has an advantage of allowing the golfer to adjust the overall weight and balance of the putter for his or her personal preference but is highly disadvantageous in that weight added to the bottom of the putter head repositions the sweet spot. In this way, although the golfer may have improved swing feel due to a better balance and a desirable weight, the overall putting effectiveness might not improve due to the size, shape, and new position of the sweet spot.

SUMMARY

A putter head is provided that concentrates the weight of the putter head at the far ends of the heel and toe of the putter head. The putter head has an ultralight putter body that includes a putter face and a shank for attaching a putter shaft. The ultralight putter body has an axially aligned heel cavity and toe cavity that are constructed to receive weights. The heel weight and toe weights are very dense, and constructed to be received into the respective weight cavity of the light putter body. Due to the extreme concentration of weight at the far ends of the heel and toe of the putter head, the putter face has exceptional rotational stability with a substantially larger sweet spot than known putter heads. The weights may be provided as changeable weight pairs, such that the overall weight and balance of the putter head may be adjusted, while maintaining the position of the sweet spot.

A preferred embodiment of the putter head is directed to a blade style putter head where at least 60% of the weight of the putter head is concentrated at the far ends of the heel and toe portions of the putter head. In one example, the total mass of the heel and toe weights is about 2 times the total weight of the ultralight putter body. For example, the putter body may be in the range of about 125 grams, and the total of the heel and toe weights may be in the range of 200 to 250 grams. Such an extreme concentration of weight at the far ends of the putter body enable substantially higher rotational stability and moment of inertia, as well as a precise placement of a much larger sweet spot. Further, as the heel and toe weights may be provided at different total weights, the overall balance and feel of the putter may be adjusted to the feel and balance for a particular golfer, while maintaining the same center of gravity.

In use, by providing the putter head with (1) an exceptionally high moment of inertia, and (2) an enhanced sweet spot, the golfer will more consistently strike the ball with the desired line and speed. An importantly, will sink more putts, get lower scores, and have a more enjoyable game.

Another preferred embodiment of the putter head is directed to a blade style putter head where at least ⅔ of the weight of the putter head is concentrated at the far ends of the heel and toe of the putter head.

Advantageously, an extreme concentration of the weight at the ends of the putter body provide for a highly desirable putter face rotational stability and an unexpectedly large sweet spot. By concentrating the weights at the ends of the putter head, the putter head has exceptional rotational inertia such that the golfer is able to control the opening and closing strike positions precisely to maintain a stable and consistent strike angle for the golf ball. Further, the concentration of weight at the far ends of the putter head creates a substantially and surprisingly large sweet spot. Rather than being measured in a few millimeters, it has been found that extreme positioning of the weights at the far ends of the putter head creates a sweet spot that can be measured in the tens of millimeters. This order of magnitude increase in sweet spot size dramatically affects the transfer of energy from the golf head to the golf ball, and enables the more casual golfer to more often successfully find the sweet spot when putting. Since the putter head has exceptional rotational stability, even if the golfer misses the precise center of gravity of the club face, the club face resists twisting, and therefore very little energy is lost, resulting in a very forgiving putter with a large sweet spot. The new putter head, with its exceptional rotational stability, and its enhanced sweet spot, enables a much more consistent putt, meaning that the golf ball goes the direction, speed and distance expected by the golfer.

BRIEF DESCRIPTION OF THE DRAWINGS

These and other objects and advantages of the invention will become apparent upon reading the following detailed description and upon referring to the drawings and claims.

DETAILED DESCRIPTION OF THE EXEMPLARY EMBODIMENTS

Figure 1:
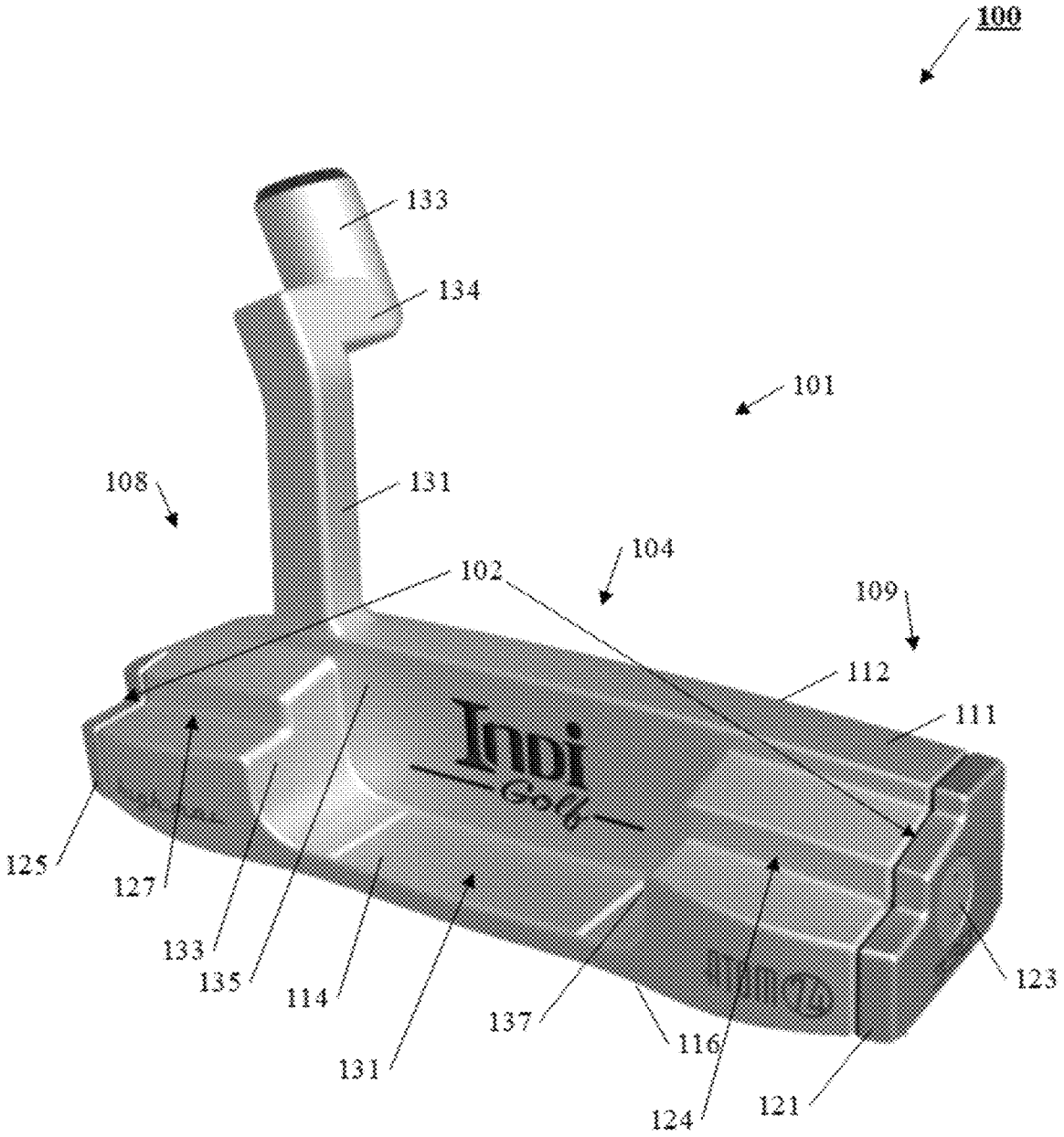
FIG. 1 is an isometric back view of a golf putter head in accordance with the present invention.

The embodiments and examples shown herein are to provide enough information to fully understand the invention. One skilled in the art will understand how minor changes or deviations can be made and still be within the scope of the invention. The following description of exemplary embodiments of the invention is not intended to limit the scope of the invention to these exemplary embodiments, but rather to enable any person skilled in the art to make and use the invention.

Embodiments of the present invention are directed to a new head design for a golf putter. The golf putter has an ultralight putter body that includes a putter face and a shank for attaching a putter shaft. The ultralight putter body has an axially aligned heel cavity and toe cavity that are constructed to receive weights. The heel weight and toe weights are very dense, and constructed to be received into the respective weight cavity of the light putter body. These heel and toe weights are sized and constructed to keep the center of gravity centered and consistent on the putter face, and due to the extreme concentration of weight at the far ends of the heel and toe of the putter head, the putter face has exceptional rotational stability with a substantially larger sweet spot.

A preferred embodiment is directed to a blade style putter head where over 60% of the weight is concentrated at the far ends of the heel and toe of the putter head. In one example, the total mass of the heel and toe weights is about 2 times the total weight of the ultralight putter body. For example, the putter body may be in the range of about 125 grams, and the total of the heel and toe weights may be in the range of about 200 to 250 grams. Such an extreme concentration of weight at the far ends of the putter body enable substantially higher rotational stability, as well as a precise placement of a much larger sweet spot. Further, as the heel and toe weights may be provided at different total weights, the overall balance and feel of the putter may be adjusted to the feel and balance for a particular golfer, while maintaining the same center of gravity.

As shown in the included figures, the illustrations depict instances of an axially weighted golf putter head and its component parts. When possible, the same reference character has been used to identify the same part on multiple figures. Advantageously, the increased moment of inertial and larger sweet spot enable putting on a more consistent line and at the expected distance.

Referring now to FIG. 1 an axially weighted putter head 100 is illustrated. Putter head 101 is generally constructed with an ultralight putter body 104 and a set of weights 102. The putter body 104 has an elongated blade portion 111 that has a putter face 112 for striking the golf ball. A shank riser 131 extends from the blade portion 111 to provide connection to a putter shaft (not illustrated). In some cases, the shank riser 131 may have an offset portion 134 that connects to the actual shaft connector 133. It will be understood that many different shank and shaft connection designs may be used consistent with this disclosure. The far end of the putter body 104 with the shank riser 131 is called the heel end 108, and the other far end of the putter body 104 is referred to as the toe end 109.

The weights 102 are concentrated at the heel end 108 and toe end 109 of the putter body 104. In particular, a heel weight 125 is received into a weight cavity 127 at the heel end, and a toe weight 121 is received into a weight cavity 124 at the toe end. In one embodiment, the weights at both the heel and toe and are coupled to the putter body 104 using screws, such as screw 123. It will be understood that other attachment mechanisms may be used such as threading, friction, or snapping. Between the weight cavity 127 and the weight cavity 124, an open space 131 is provided for the putter body 104. The open space 131 provides that more mass is concentrated toward the far ends of the heel and toe of the putter body 104, thereby contributing to the concentration of overall weight to the ends of the putter head 101.

The open space 131 is bounded by the back face 135 of blade 111, the back face 133 of the weight cavity 127, and the back face 137 of weight cavity 124.

In one particular design, the ultralight body 104 is constructed primarily from a lightweight aluminum alloy, and the weights 102 are constructed primarily from tungsten. By incorporating these materials, it is possible to construct a putter head 101 where the weights 102 may represent up to approximately 60% to 70% of the weight of the putter head 101. That is, the putter body itself 104, may only represents about 30% to 40% of the overall weight, with the vast concentration of weight being at the far ends of the heel and toe of the putter 101. The distribution of weight between the heel weight 125 and the total weight 121 may be approximately equal, however in some cases it may be desirable to place somewhat more weight at the toe and for stability and overall balance of the putter head 100. It will be appreciated by one skilled in the art that the combined weight of the heel and toe weights may be more than 70% of the total weight of the putter head, for example up to, and even exceeding, 80%. By concentrating even more weight to the far heel and toe ends of the putter head, additional rotational stability, exceptionally high moment of inertia, and sweet spot enlargement may be enabled.

It will be understood that other materials may be used for the ultralight putter body. For example, several alternative aluminum alloys may be substituted, as well as Magnesium, carbon composites or high-impact plastics, for example. It will also be understood that other dense materials may be used for the weights, for example, lead or other high-density plastics or composites.

In the illustrated design, the concentration of weight at the far ends of the heel and toe of the putter head 101 results from both (1) constructing the putter body 104 such that much of its mass is at the heel and toe ends by maximizing the size of the open space 131, and (2) by securing extremely heavy weights into the cavities at the heel and toe ends. It will be understood that other designs may be used to concentrate an extreme amount of weight at the heel and toe ends of the putter head 101.

Contributing further to the balance and stability, the weights 102 are connected into the putter body 104 on a center of gravity axis that is transverse to the ball strike point on the face 112, and parallel to the blade body 111. The weights 121 and 125 are sized and shaped such that the sweet spot is centered precisely on the face 112. As some golfers prefer a differently weighted putter head, the weights 102 may be provided in different total weights. In this way, a golfer may adjust the overall feel and balance of the putter head 101, but as the weights 102 are sized and constructed to be connected along the center of gravity axis, the positioning of the sweet spot remains the same, independent of which weight set 102 is used.

Although the putter head 101 has been described as having between 60% and 80% of its weight concentrated in weights 102, it will be understood that other distributions provide desirable effects. However, it is been found that a weight distribution of the weights 102 anywhere from 60 to 80% of the total putter head weight provides desirable balance, feel, stability while creating a large sweet spot.

Advantageously, an extreme concentration of the weight at the ends of the putter body 104 provide for a highly desirable putter face rotational stability and an unexpectedly large sweet spot. First, by concentrating the weights at the ends of the putter head, the putter head 101 has exceptional rotational inertia such that the golfer is able to control the opening and closing strike positions precisely. In this way, when the golfer has carefully positioned the putter face 112 in his or her backswing, and then begins swinging the putter head 101 towards the golf ball, the desirable rotational inertia causes the putter face putter face 112 to maintain a stable strike angle for the golf ball. With such a stable strike angle, the ball is far more likely to move along the line expected by the golfer. Second, the concentration of weight at the far ends of the heel and toe of the putter head creates a substantially and surprisingly large sweet spot. Rather than being measured in a few millimeters, it has been found that extreme positioning of the weights creates a sweet spot that can be measured in the tens of millimeters. This order of magnitude increase in sweet spot size dramatically affects the transfer of energy from the golf head to the golf ball, and enables the more casual golfer to more often successfully find the sweet spot when putting. Putter head 101, with its desirable rotational stability, and its enhanced sweet spot, enables a much more consistent putt, meaning that the golf ball goes the direction and speed expected by the golfer. As will be appreciated, when the golf ball leaves the putter head on the correct line and at the expected speed, the ball is far more likely to travel to and into the cup.

Figure 2:
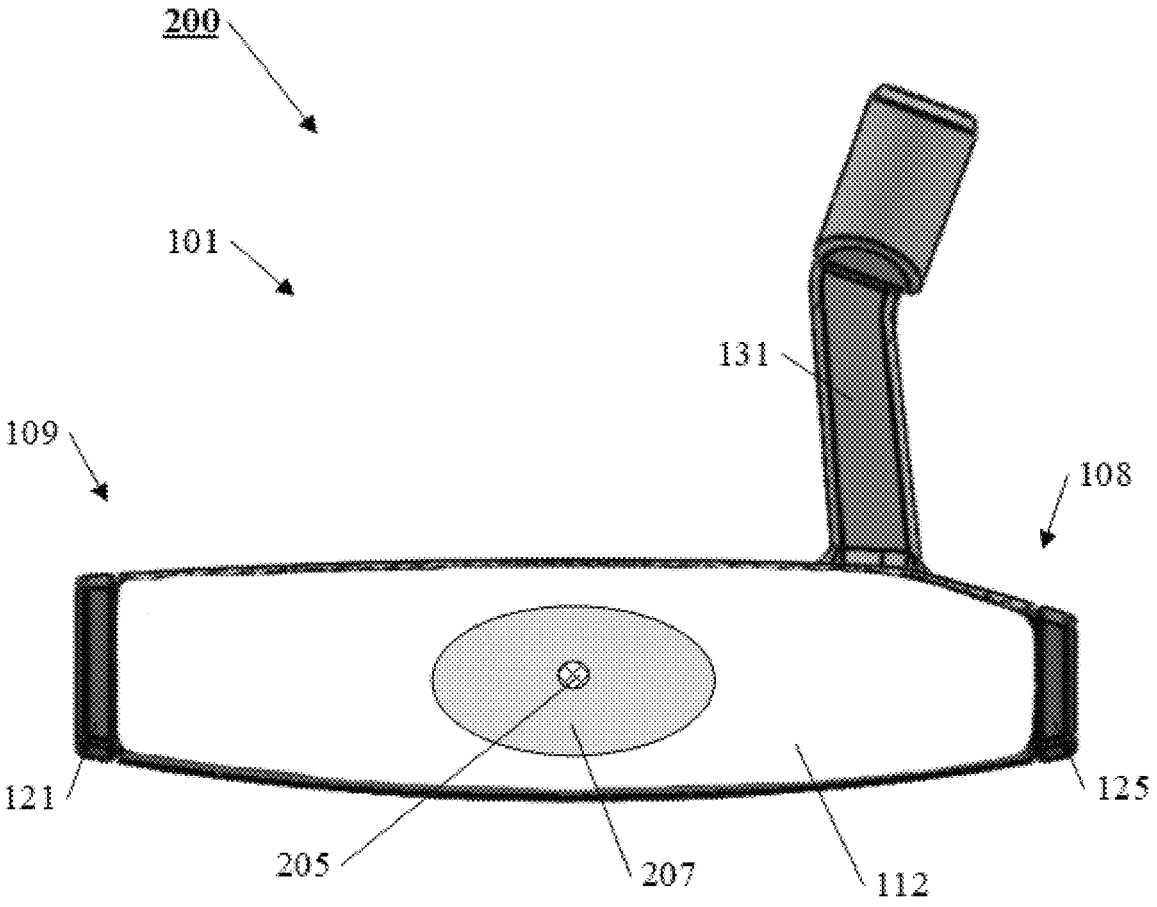
FIG. 2 is an illustration of a front view of a golf putter head in accordance with the present invention.

Referring now to FIG. 2, a front view illustration 200 of a putter head 101 is shown. Putter head 101 has riser shank 131 extending from the heel end 108, which also has heel weight 125. The toe end 109 has total weights 121. The face 112 of the putter head 101 has a center of gravity 205. The center of gravity 205 advantageously stays at a consistent position even when different weight sets are used for the putter head 101. The extreme concentration of weights at the heel 108 and toe 109 ends of the putter 101 create an extremely large sweet spot 207, which in some cases can be an order of magnitude larger than from prior art putters. Further, as described before, placing weights 121 and 125 in a way that concentrates weights at the far end of the putter head contributes dramatically to rotational stability. With the much larger sweet spot and the improved rotational stability, the putter 101 provides a highly advantageous result.

Figure 3:
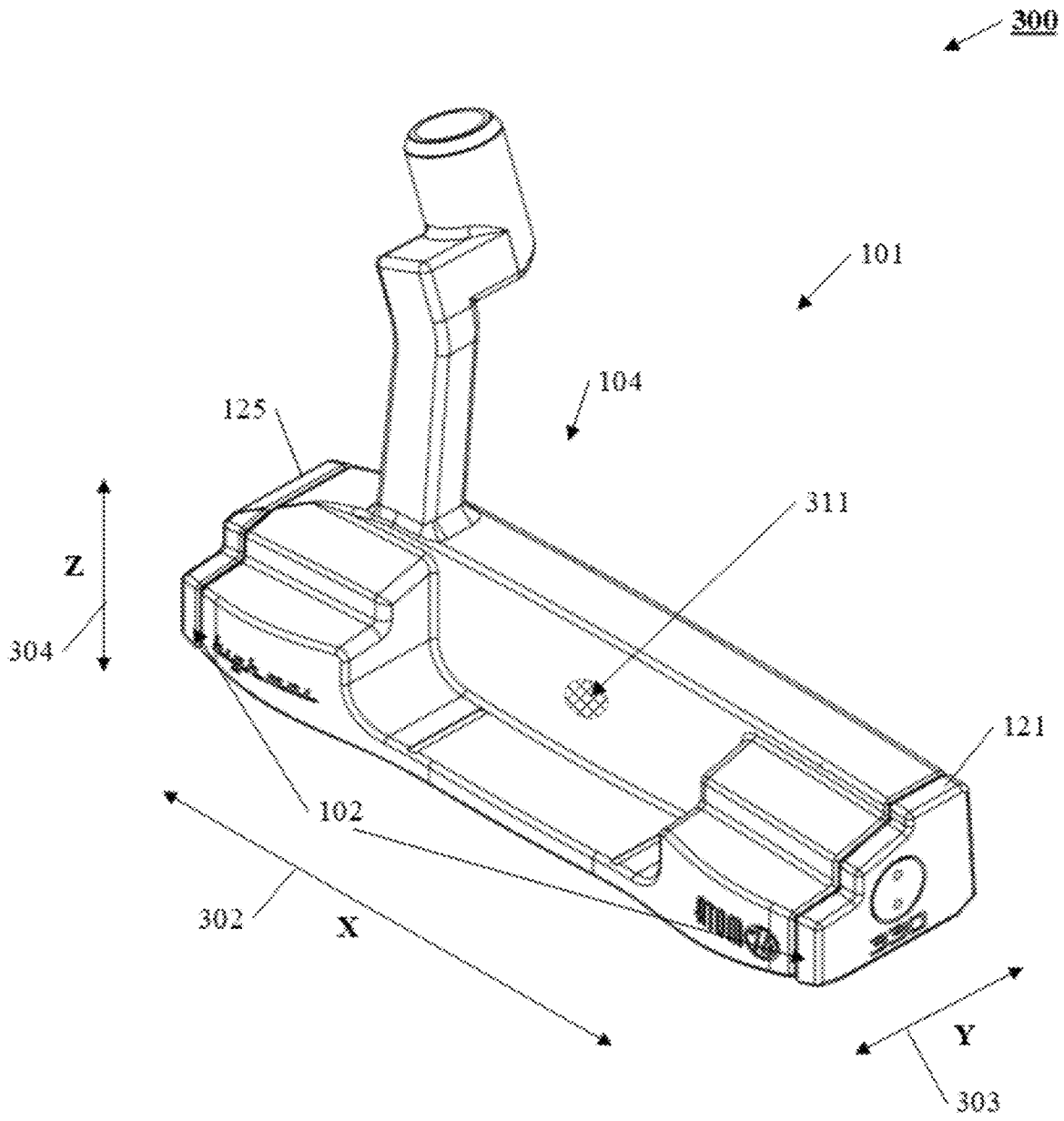
FIG. 3 is an isometric back view of a golf putter head in accordance with the present invention.

Referring now to FIG. 3, a perspective line view of golf head 101 is illustrated. Golf head 101 has ultralight body 104 having an elongated blade portion and a shaft attachment portion. Weights 102 are attached as heel weight 125 and at toe weight 121. A center of gravity axis is provided in the body 104 perpendicular to the X axis 302, which is parallel to the face of the blade 112. This center of gravity axis also is positioned along a Z axis 304 representing the height of the blade and along a Y axis 303 representing the depth of the putter 101. This center of line axis passes through the center of the sweet spot 311. Advantageously, the positioning of the sweet spot and the center of gravity axis remain consistent even when different size weight sets 102 are used.

Figure 4:
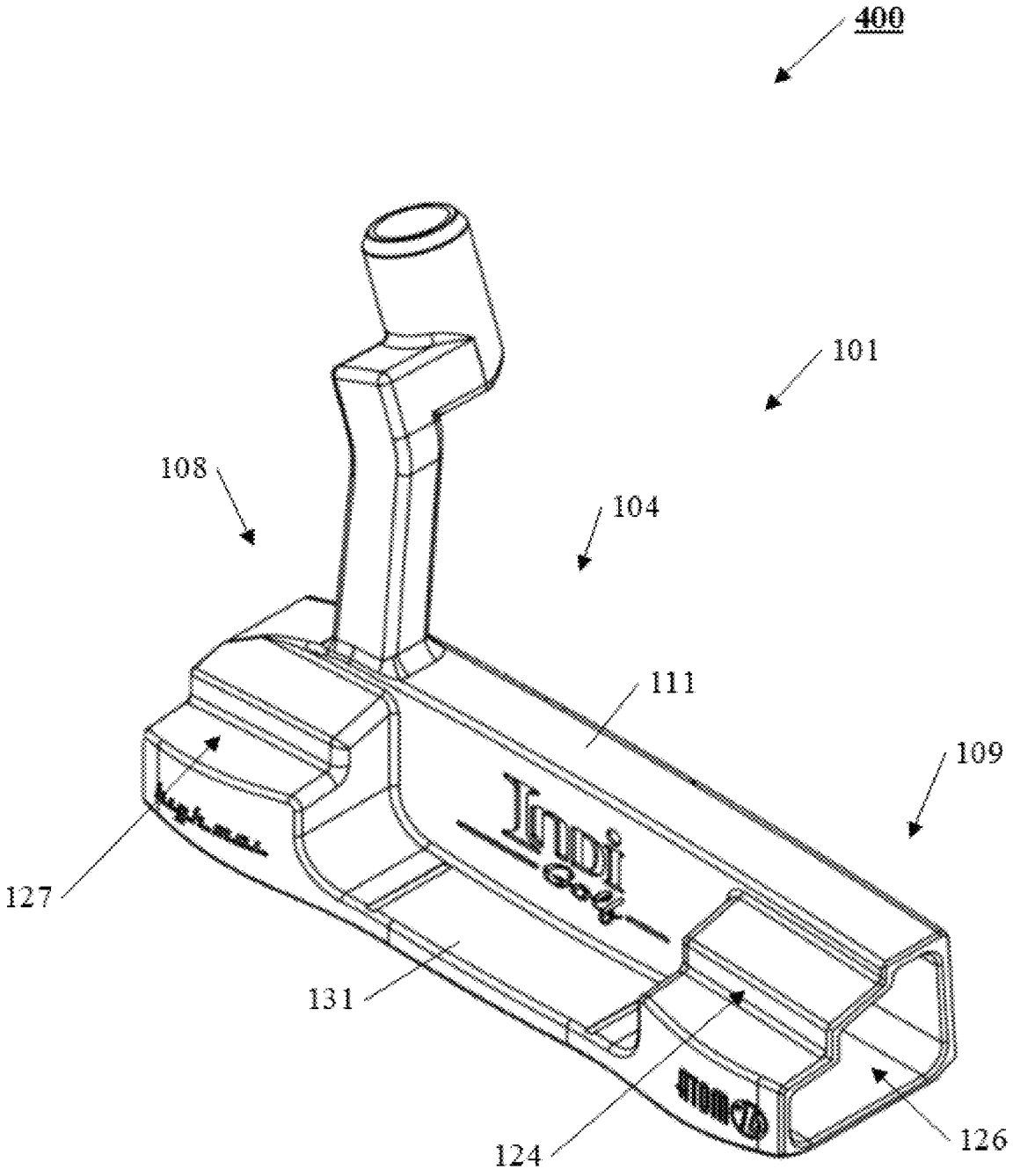
FIG. 4 is an isometric back view of a golf putter head body in accordance with the present invention

Referring now to FIG. 4, the ultralight body 400 is illustrated in a perspective line drawing. The ultralight body 104 is generally made of a light aluminum alloy and has an elongated blade portion 111 attached to a shank riser portion for attaching a putter shaft. The toe end 109 of the ultralight putter body 104 has a cavity 124 for receiving a weight. The weight is received through opening 126, and may be secured into the cavity 124 using various means, including using a threaded bolt. A weight cavity 127 is also at the heel end 108, and another weight may be received into the cavity 127 through an opening (not shown). An open space 131 is set between the toe end cavity 124 and the heel end cavity 127.

Figure 5:
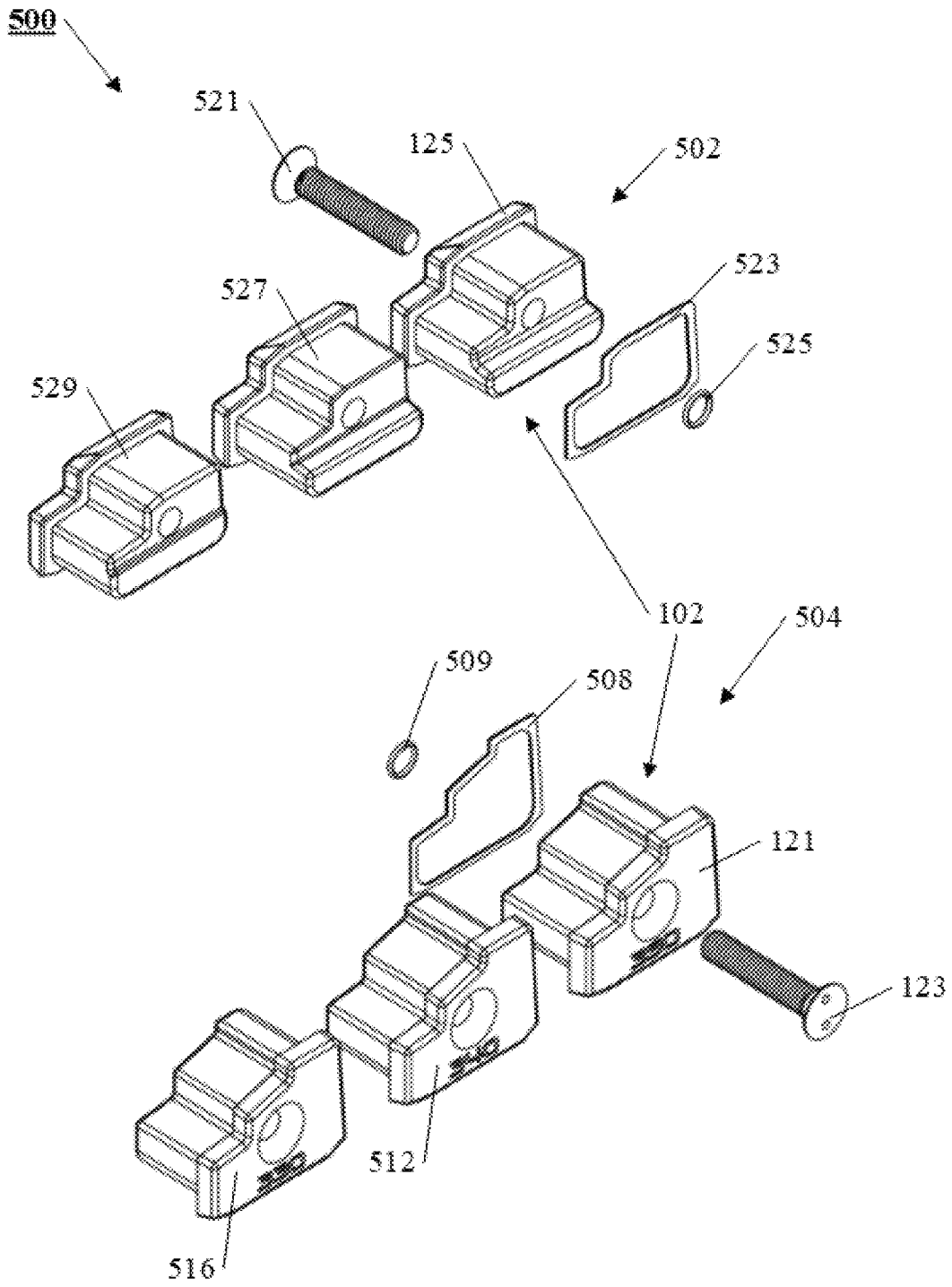
FIG. 5 is an isometric exploded view of weights for connection to a golf putter head body in accordance with the present invention

Referring now to FIG. 5, three sets of weights 102 are illustrated. Weights 502 are sized and constructed to be received into the heel end 108 of the putter body 104, while weights 504 are sized and constructed to be received into the toe end 109 of the putter body 104. The weights 502 and 504 are constructed as a pair of weights. For example, weight 125 and weight 121 form a weight pair, weight 527 and weight 512 form a weight pair, and weight 529 and weight 516 form a weight pair. Each of the weight pairs is sized and shaped such that together they provide a desirable mass for a golfers desired overall weight and balance, but when inserted into body 104, keep the center of gravity and sweet spot consistent. The weights are attached into the body 104 using screws, such as screw 123 and screw 521. It will be appreciated that other attachment mechanisms may be used.

When inserting a weight into the heel 108 portion of the putter body 104, a small rubber grommet 525 is first inserted and then a gasket 523 is positioned onto the perimeter of the weight. As the screw 521 is tightened into the putter body 104, the weight 125 compresses the gasket 525 tightly against the putter body 104. By including gasket 525, it has been found that the putter head 101 gives a highly desirable sound and feel when the golfer strikes the golf ball. This sound and feel is of particular importance of the golfer, as it gives an immediate feedback as to whether or not the golf ball has struck the sweet spot of the putter head. Further, the pleasant sound of a golf ball hitting the sweet spot also notifies those playing with the golfer that he or she has had a successful strike. In a similar manner, at the toe end a grommet 509 would be used along with a gasket 508 on weight 121, which would be screwed into putter body 104 using screw 123.

Figure 6:
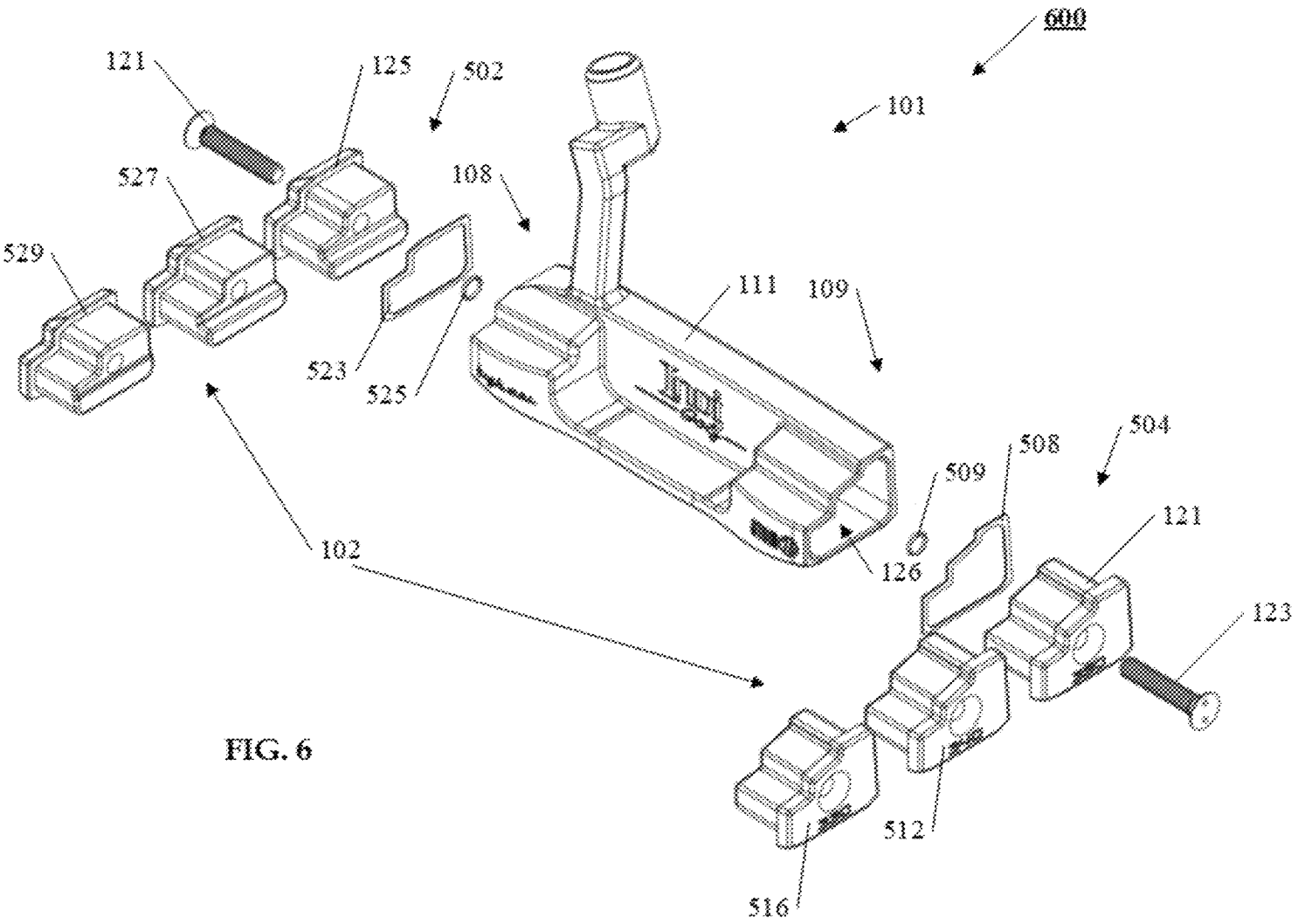
FIG. 6 is an isometric exploded view of a golf putter head in accordance with the present invention

Referring now to FIG. 6, an exploded view 600 of golf head 101 is illustrated. Golf head 101 has a blade portion 111 with a shaft connection mechanism at heel end 108 and a toe end 109. Weights, such as weights 121, 512, or 516 are inserted into opening 126 using grommet 509, gasket 508, and screw 123. In this way toe-end weight 504 provides extreme concentration of weight at the toe end. In one example, these toe weights 504 are constructed of dense tungsten, and the ultralight putter body is constructed of lightweight aluminum. It will be appreciated that other materials may be substituted. At the heel end 108, heel weights 502, such as weight 125, weight 527, or weight 529 are inserted into the heel cavity using grommet 525, gasket 523, and screw 121. Again, the high concentration of weight at the far heel and toe ends of the putter body provides for dramatically improved rotational stability, as well as a significantly larger sweet spot.

Figure 7:
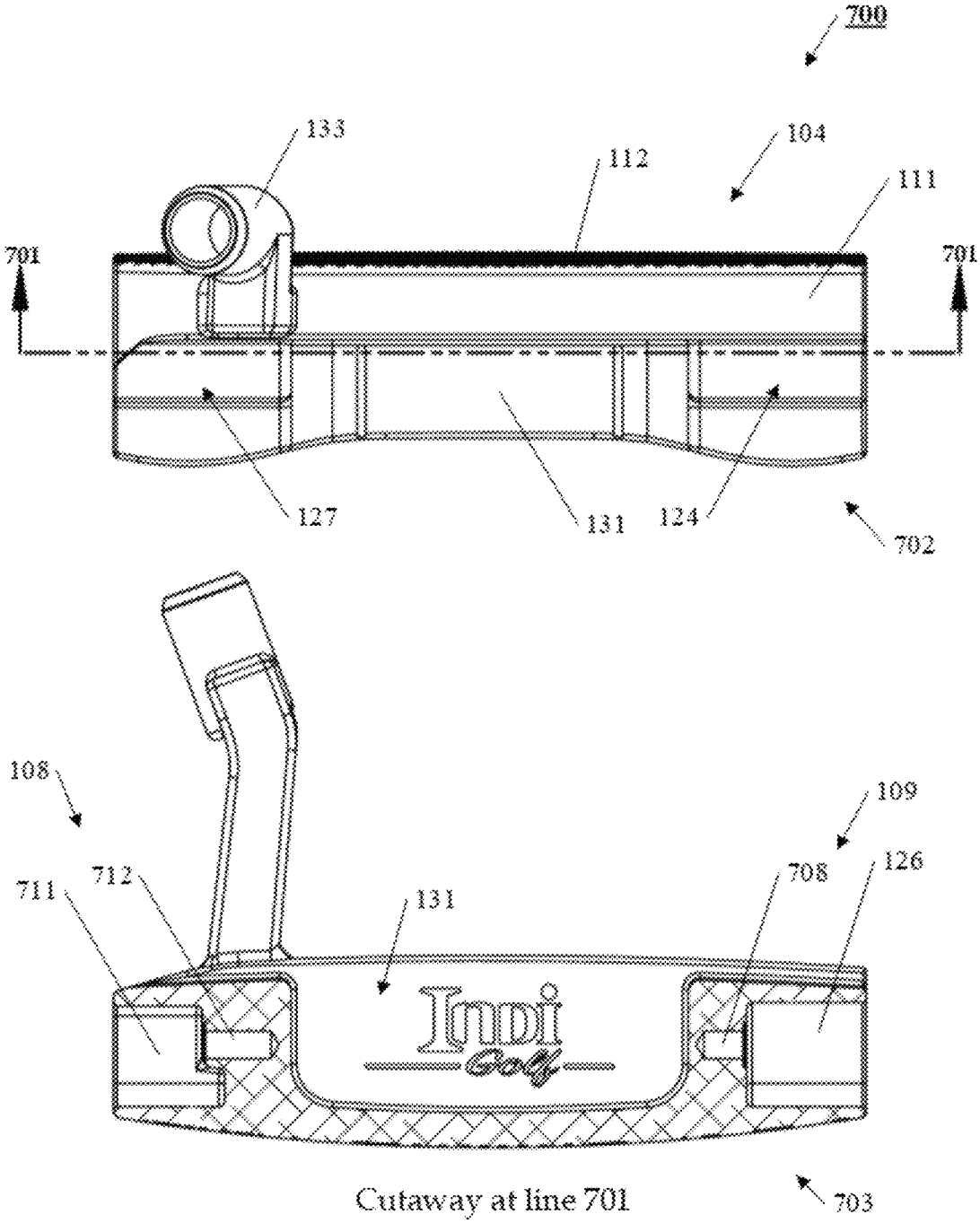
FIG. 7 is a top view and a cutaway view of a golf putter head in accordance with the present invention

Referring now to FIG. 7, a top and cutaway view is illustrated for putter body 104. The top view 702 shows the putter face 112 on the blade portion 112 along with the shaft connector 133. A toe weight cavity 124 is at the toe and of the putter body 104 and a heel weight cavity 127 is at the heel end of putter 104. An open space 131 is positioned between the toe cavity 124 and the heel cavity 127. Cutaway illustration 703 shows a cutaway of the putter body 104 along line 701. Cutaway view 703 shows opening 126 for receiving a toe weight and an opening 711 for receiving a heel weight. The toe weight 126 has a threaded receiver 709 for receiving a threaded screw for retaining a weight into cavity 126, and the heel portion has a threaded receiver 712 for receiving a threaded screw to hold a weight into opening 711

Figure 8:
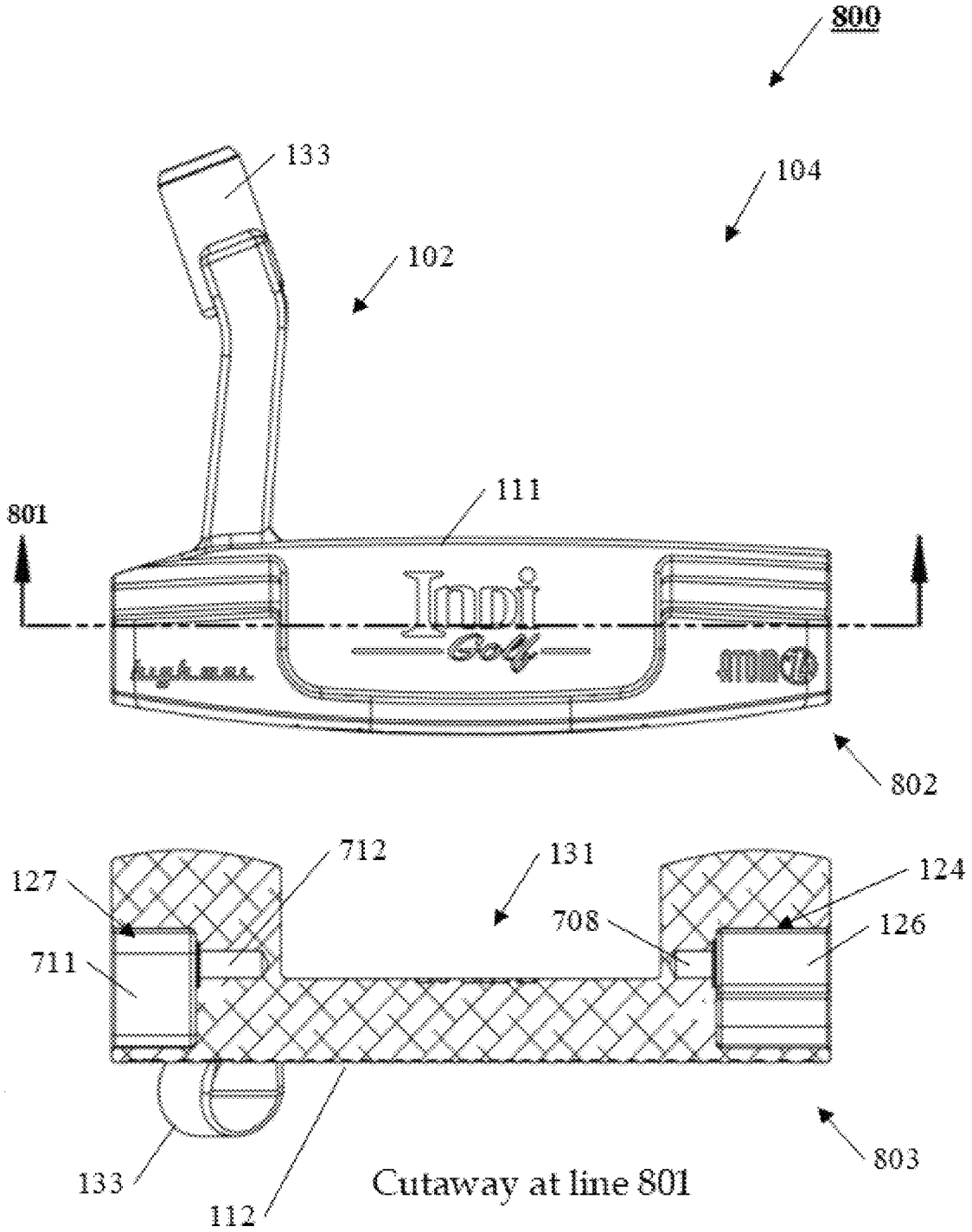
FIG. 8 is a back view and a cutaway view of a golf putter head in accordance with the present invention FIG. 9 are side views of a golf putter head in accordance with the present invention While the invention will be described in conjunction with example embodiments, it will be understood that it is not intended to limit the invention to such embodiments. On the contrary, it is intended to cover all alternatives, modifications and equivalents as may be included within the spirit and scope of the invention.

Referring now to FIG. 8, a back and cutaway view 800 of the putter body 104 is illustrated. Putter body 104 has a blade portion 111 that has a riser 133 extending to receive a putter shaft. The putter body 104 is shown along cutaway line 801 in illustration 803. Illustration 803 shows the putter face 112 and the riser structure 133. A toe cavity 124 has an opening 126 with a threaded receiver 708 for receiving a threaded screw. A heel end cavity 127 has opening 711 for receiving a threaded screw 712. An opening 131 is positioned between the toe cavity 124 and the heel cavity 127 that provides for further concentrating weight toward the ends of the putter head 101.

Figure 9:
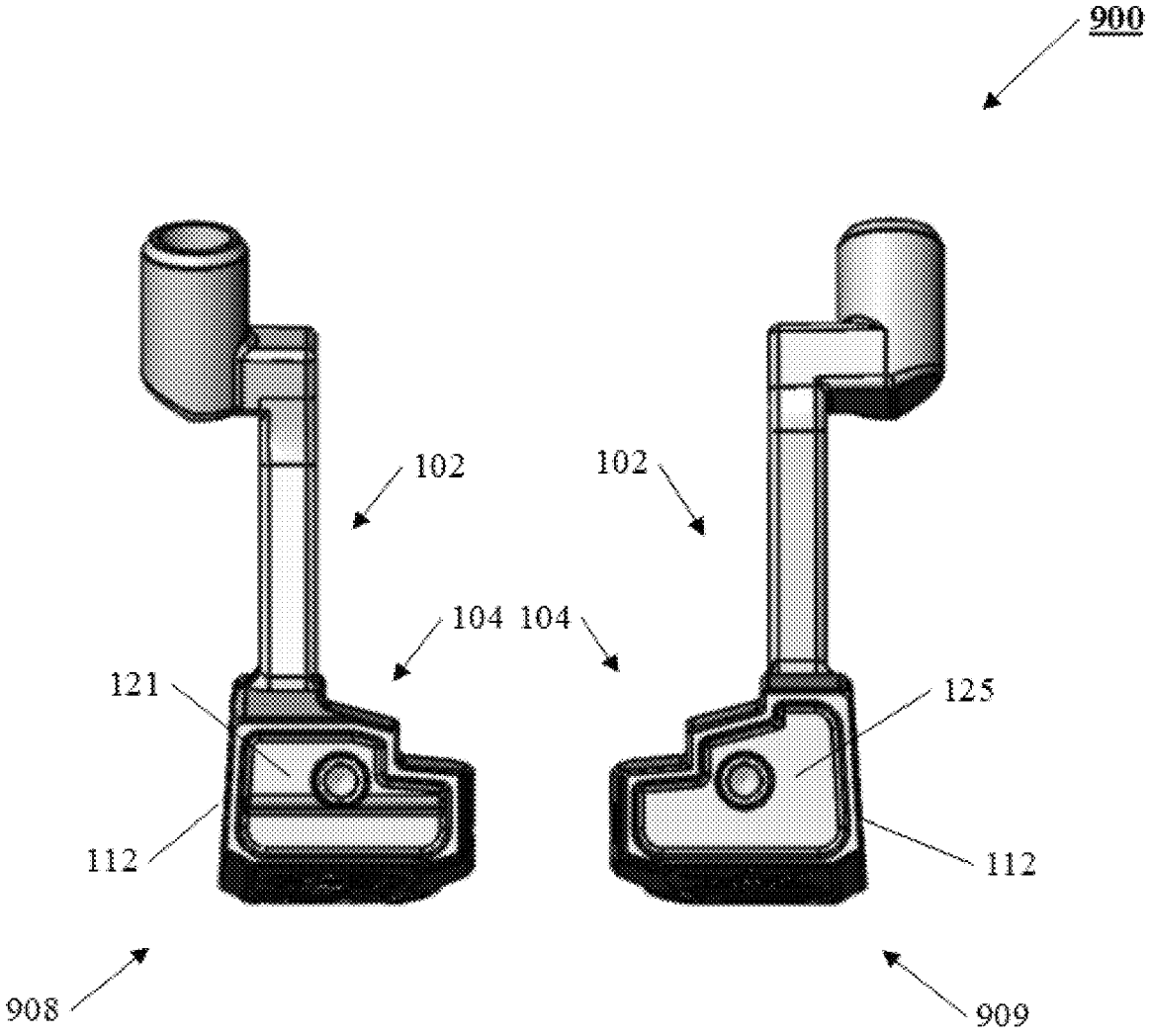

Referring now to FIG. 9, back and side views 900 of the putter head 101 are illustrated. Illustration 908 shows the putter head 101 from the heel end of the putter body 104. As such, weight 125 is illustrated threadably received into the heel end cavity. Illustration 909 shows the putter body 104 from the toe end, showing weight 121 threadably connected into the toe cavity.

While particular preferred and alternative embodiments of the present intention have been disclosed, it will be appreciated that many various modifications and extensions of the above described technology may be implemented using the teaching of this invention. All such modifications and extensions are intended to be included within the true spirit and scope of the appended claims.

What is claimed is:

1. A putter head, comprising:

A putter body having a ball face and shaft connector, the putter body having a heel end and a toe end;

a heel weight cavity and a toe weight cavity in the ends of the putter body;

a weight set removably received into the cavities further comprising:

a heel weight having a heel flange, a heel gasket, and a heel connector constructed to removably fix the heel weight into the heel cavity and to compress the heel gasket between the putter body and the heel flange;

a toe weight having a toe flange, a toe gasket and a toe connector constructed to removably fix the heel weight into the toe cavity and to compress the toe gasket between the putter body and the toe flange; and wherein (1) the weight of the weight set is more than about 60% of the weight of the putter head, (2) the heel flange extends outside the heel cavity and the toe flange extends outside the toe cavity and (3) a face of the heel flange and a face of the toe flange form a portion of the ball face.

2. The putter head according to claim 1, wherein the weight of the weight set is in the range of about 60% to 80% of the weight of the putter head.

3. The putter head according to claim 2, wherein the weight of the weight set is in the range of about 200 grams to about 300 grams.

4. The putter head according to claim 2, wherein the weight of the putter body is in the range of about 100 grams to about 150 grams.

5. The putter head according to claim 1, wherein toe weight is heavier than the heel weight.

6. The putter head according to claim 1, wherein the heel weight and the toe weight are connected to be aligned with a center of gravity axis of the putter body.

7. The putter head according to claim 1, wherein the heel connector and toe connector are threaded screws.

8. The putter head according to claim 1, wherein the putter body is substantially made from an aluminum alloy, and the toe and heel weights are substantially made from Tungsten.

9. The putter head according to claim 1, wherein the ball face has an effective sweet spot over 10 mm in diameter.

10. A putter head, comprising:

a putter body having a ball face and shaft connector, the putter body having a heel end and a toe end;

a heel weight constructed to be removabley coupled to the far heel end of the putter body with a heel connector a flange portion of the heel weight extending from the far heel end;

a heel gasket that can be compressed between the heel flange and the far heel end by the heel connector;

a toe weight constructed to be removabley coupled to the far toe end of the putter body with a toe connector a flange portion of the toe weight extending from the far toe end;

a toe gasket that can be compressed between the toe flange and the far toe end by the toe connector;

wherein the combined weight of the heel weight and the toe weight is more than about 60% of the weight of the putter head.

11. The putter head according to claim 10, wherein the combined weight of the heel weight and the toe weight is in the range of about 60% to 80% of the weight of the putter head.

12. The putter head according to claim 10, wherein the ball face has an effective sweet spot over 10 mm in diameter.

13. The putter head according to claim 10, wherein the portion of the heel weight extending from the far heel end and the portion of the toe weight extending from the far toe end each form a portion of the ball face.

14. The putter head according to claim 10, wherein:

the heel end has a heel cavity and the toe end has a toe cavity;

a portion of the heel weight is removably fixed into the heel cavity with the heel connector, and a portion of the toe weight is removably fixed into the toe cavity with the toe connector.

15. The putter head according to claim 14, wherein the heel connector is a threaded screw and the toe connector is a threaded screw.

16. A putter kit, comprising:

a putter body having a ball face and shaft connector, the putter body having a heel end and a toe end;

a heel screw and a heel gasket;

a toe screw and a toe gasket;

a set of heel weights, each heel weight constructed to removably coupled to the putter body with the heel screw to provide a far-end heel weight, at least a flange portion of the far end heel weight extending from the heel end and the heel screw compresses the heel gasket between the putter body and the flange portion of the heel weight;

a set of toe weights, each toe weight constructed to couple to the toe connector of the putter body with the toe screw to provide a far-end toe weight, at least a flange portion of the far end toe weight extending from the toe end and the toe screw compresses the toe gasket between the putter body and the flange portion of the toe weight;

wherein the combined weight of (1) the far-end toe weight and (2) the far-end heel weight is more than about 60% of the combined weight of (1) the far-end toe weight, (2) the far-end heel weight and (3) the weight of the putter body.

17. The putter head kit according to claim 16, wherein the combined weight of (1) the far-end toe weight and (2) the far-end heel weight is in the range of about 60% to 80% of the combined weight of (1) the far-end toe weight, (2) the far-end heel weight and (3) the weight of the putter body.

18. The putter head kit according to claim 16, wherein each heel weight in the set of heel weights is a different weight and each toe weight in the set of toe weights is a different weight.

19. The putter head kit according to claim 16, wherein the toe screw is constructed to couple only one toe weight at a time, and the heel screw is constructed to couple only one heel weight at a time.

20. The putter head according to claim 16, wherein the ball face has an effective sweet spot over 10 mm in diameter.

21. The putter head according to claim 16, wherein:

the heel end has a heel cavity and the toe end has a toe cavity;

a portion of the heel weight is removably set into the heel end with the heel screw, and a portion of the toe weight is removably set into the toe end with the toe screw.

* * * * *